US007341307B2

(12) United States Patent
Parker et al.

(10) Patent No.: US 7,341,307 B2
(45) Date of Patent: Mar. 11, 2008

(54) COFFEE LOUNGE

(76) Inventors: James Aaron Parker, 158 Dolphin Cir., Marina, CA (US) 93933; Vincent Todd Herring, P.O. Box 2902, Salinas, CA (US) 93902; James Douglas Parker, 3621 Tina Pl., Stockton, CA (US) 95215

( * ) Notice: Subject to any disclaimer, the term of this patent is extended or adjusted under 35 U.S.C. 154(b) by 0 days.

(21) Appl. No.: 11/544,824

(22) Filed: Oct. 6, 2006

(65) Prior Publication Data

US 2007/0080572 A1 Apr. 12, 2007

Related U.S. Application Data

(60) Provisional application No. 60/725,017, filed on Oct. 7, 2005.

(51) Int. Cl.
*A47B 85/06* (2006.01)

(52) U.S. Cl. ..... 297/119; 297/423.41; 108/13

(58) Field of Classification Search ..... 297/423.41, 297/118, 119, 440.1, 440.14, 461, 462; 108/11, 108/13 X See application file for complete search history.

(56) References Cited

U.S. PATENT DOCUMENTS

| | | | | |
|---|---|---|---|---|
| 2,925,851 | A * | 2/1960 | Weiss | 297/119 |
| 3,139,308 | A * | 6/1964 | Hershberger et al. | 297/423.41 |
| 3,241,885 | A * | 3/1966 | Deaton | 297/119 |
| 4,031,831 | A | 6/1977 | Davis | |
| 5,597,199 | A | 1/1997 | Hoffman et al. | |
| 6,113,182 | A | 9/2000 | Wise | |
| 6,174,026 | B1 | 1/2001 | Wise | |
| 6,296,314 | B1 * | 10/2001 | Klein | 297/119 X |

* cited by examiner

*Primary Examiner*—Anthony D. Barfield
(74) *Attorney, Agent, or Firm*—James Ray & Assoc.

(57) ABSTRACT

An article of furniture comprising a frame including a first portion disposed in a horizontal direction and having an opening centrally disposed therein and a second portion attached to an underside of the first portion and disposed in a vertical direction. A predetermined plurality of leg members are connected to such underside of the frame's first portion of said frame to maintain the frame at a desired height. A flat member having a smooth finish on one side and a cushion on an opposite side. A first device is provided to enable rotating of the flat member to expose one of such smooth finish and such cushion as desired. There is a second device provided to maintain the flat member in a substantially horizontal plane during use.

16 Claims, 5 Drawing Sheets

COFFEE LOUNGE

CROSS REFERENCE TO RELATED APPLICATION

This application is closely related to and claims benefit from U.S. Provisional Patent Application Ser. No. 60/725,017 filed on Oct. 7, 2005.

FIELD OF THE INVENTION

The present invention relates, in general, to articles of furniture and, more particularly, this invention relates to an article of furniture which can be converted from one particular use such as a coffee table into a second separate use such as an ottoman.

BACKGROUND OF THE INVENTION

Articles of furniture such as coffee tables and ottomans have been known in the prior art prior to the conception and development of the present invention. However, as is equally well known, most all of these articles of furniture have been marketed as a separate piece of furniture.

Many rooms in various residences, particularly efficiency apartments and hotel rooms, do not have enough space to have each of these articles of furniture and, therefore, must choose between the particular piece of furniture which will serve the most use in the space allowed. For example, some may wish to have a place to put food and beverages while watching television, while others may want a place to support their legs while enjoying watching television or talking on the phone.

On the other hand, the known prior art type convertible units require rather complex mechanisms for changing from one use to another. See, for example, U.S. Pat. Nos. 5,597,199; 6,174,026; 6,133,182 and 4,031,831.

SUMMARY OF THE INVENTION

The present invention provides an article of furniture having a predetermined number of uses. For example, such article of furniture can be converted from a coffee table into an ottoman and vice versa. The article of furniture comprises a frame having each of a first predetermined shape and a predetermined size. The frame includes a first portion disposed in a substantially horizontal direction and having an opening centrally disposed therein and a second portion attached to an underside of the first portion and disposed in a substantially vertical direction. There are a predetermined plurality of leg members having a predetermined length and a second predetermined shape connected to the underside of such first portion of the frame for maintaining such frame at a desired height above floor level. A substantially flat rotatable member having a smooth finish on one side thereof and a cushion disposed on an opposite side thereof is provided. A first means having a first portion thereof disposed on an inner surface of such second portion of the frame and a second portion disposed diametrically opposite such first portion for enabling rotating the substantially flat member to expose one of such smooth finish and such cushion as desired. A third portion of the first means is disposed on a first edge of the substantially flat member and a fourth portion of such first means is disposed diametrically opposite the third portion and on a second edge of such substantially flat member. Finally, there is a second means engageable with such second portion of the frame on an inner surface thereof and with such substantially flat member for maintaining the substantially flat member in a substantially horizontal plane during use.

OBJECTS OF THE INVENTION

It is, therefore, one of the primary objects of the present invention to provide an article of furniture having a plurality of uses without requiring additional floor space.

Another object of the present invention is to provide an article of furniture having a plurality of uses which is relatively simple to operate.

Still another object of the present invention is to provide an article of furniture having a plurality of uses which is less costly to manufacture than prior art type articles of furniture.

Yet another object of the present invention is to provide an article of furniture having a plurality of uses which is more attractive.

A further object of the present invention is to provide an article of furniture having a plurality of uses which requires relatively few moving parts.

An additional object of the present invention is to provide an article of furniture having a plurality of uses which can be made into a variety of shapes and sizes.

In addition to the several objects and advantages of the present invention which have been described in considerable detail above it should be noted that various additional objects and advantages of the present invention may be envisioned by those persons who are skilled in the furniture art from the following more detailed description of the invention, particularly, when such detailed description is taken in conjunction with the attached drawing figures and the appended claims.

Figure 1:
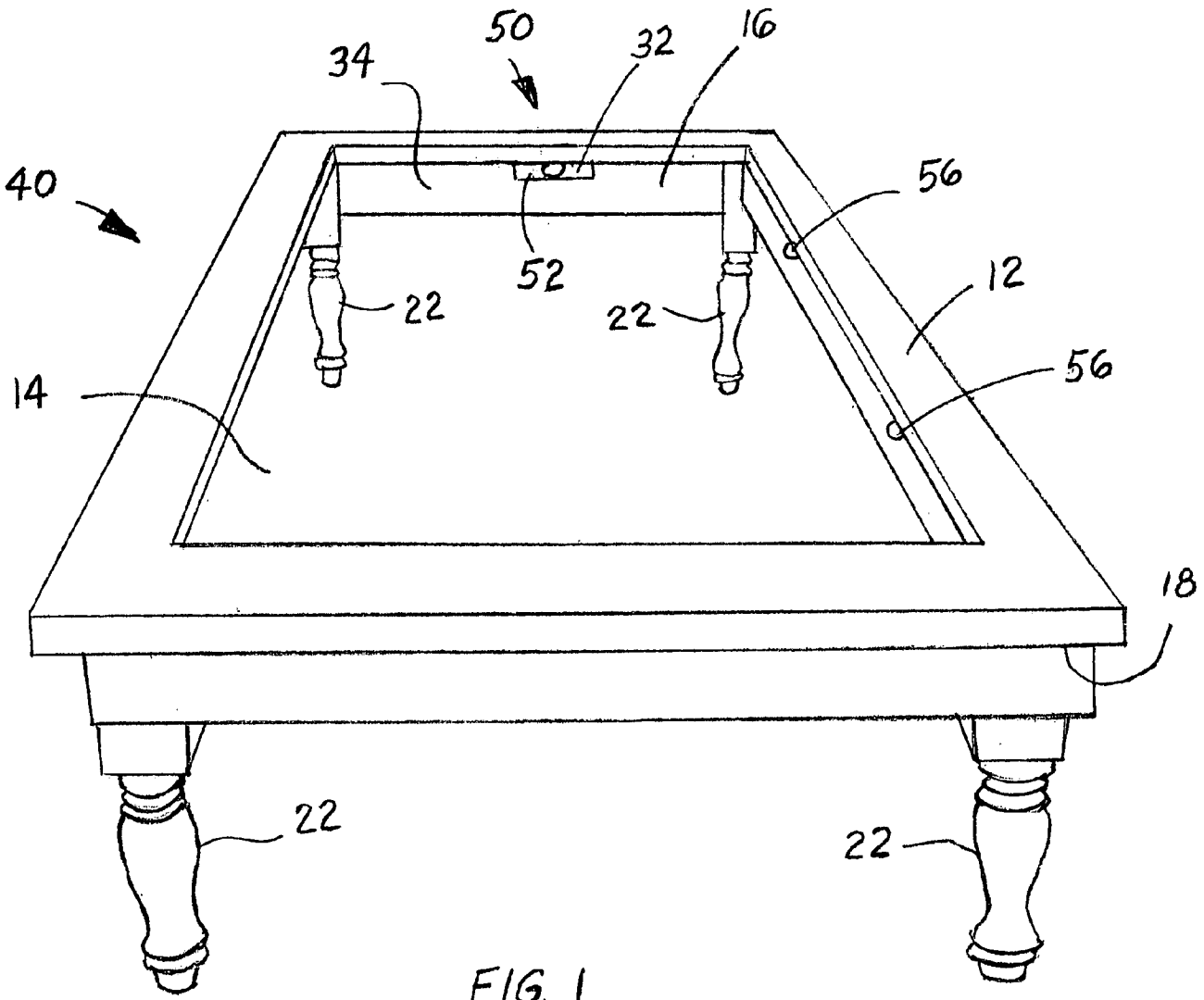
FIG. 1 is perspective view of a presently preferred embodiment of the frame member of the article of furniture according to the present invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
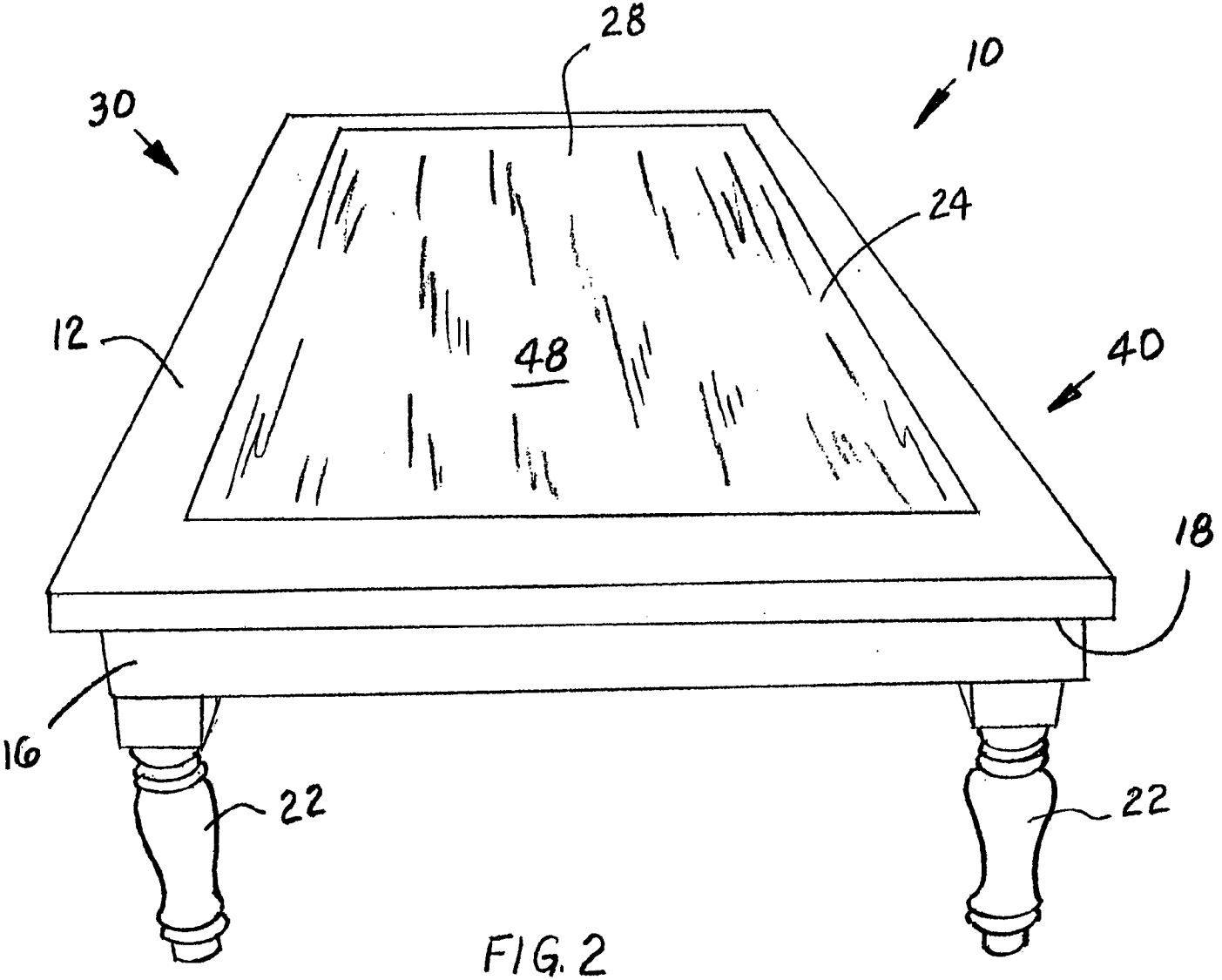
FIG. 2 is a perspective view showing a cushion top of the article of furniture illustrated in FIG. 1.
Figure 3:
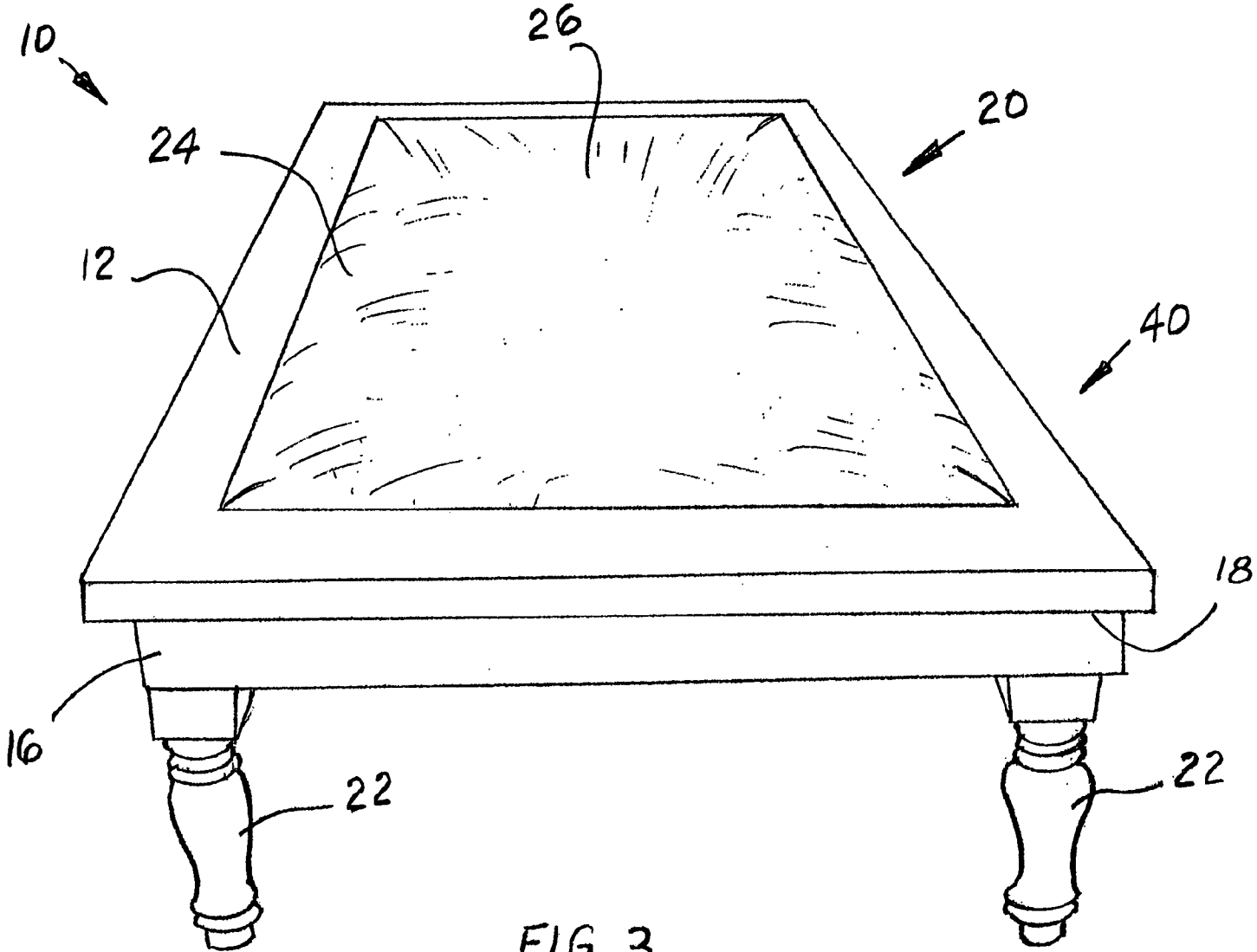
FIG. 3 is a perspective view showing a smooth top surface of the article of furniture illustrated in FIGS. 1 and 2.
Figure 4:
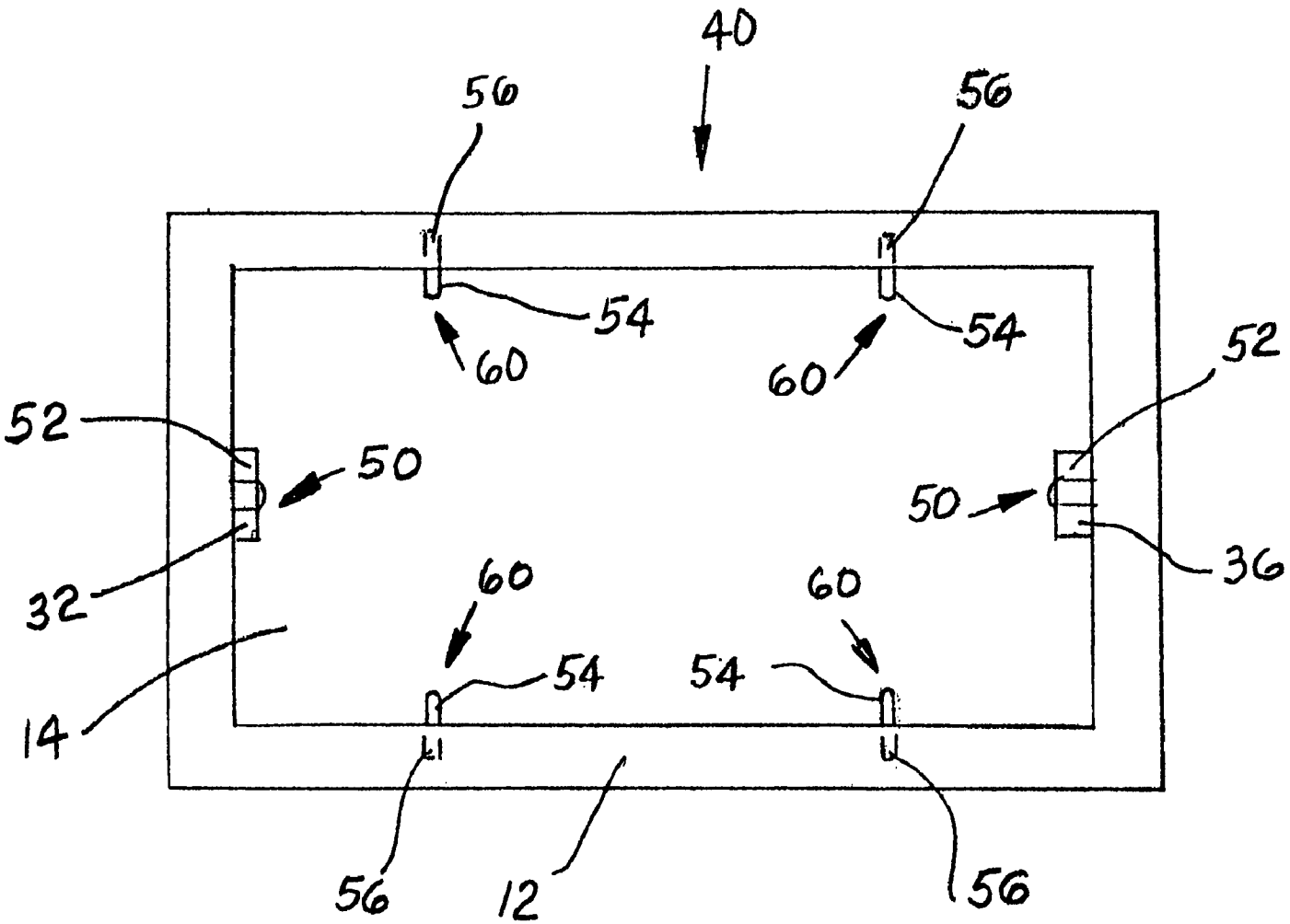
FIG. 4 is a top view of the frame member showing placement of the U-shaped member of the pivot means and the means for maintaining the flat member in a substantially horizontal plane.
Figure 5:
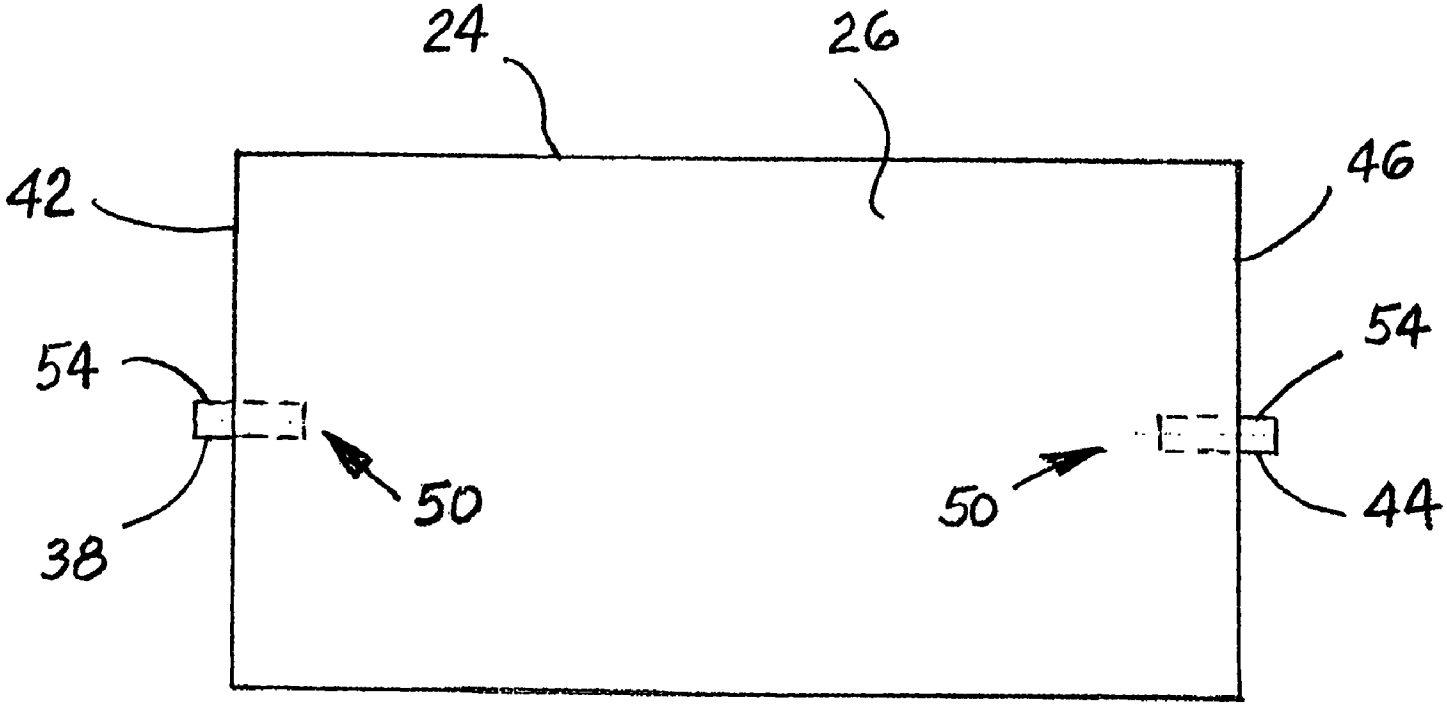
FIG. 5 is a top view of the flat member showing placement of the pin members of the pivot means engageable with the frame member.

Now refer, more particularly, to FIGS. 1-5. Illustrated therein is a presently preferred embodiment of the article of furniture, generally designated 10, which can be converted from a coffee table, generally designated 20, into an ottoman, generally designated 30, and vice versa. Such article of furniture 10 includes a frame member, generally designated 40, having each of a first predetermined shape and a predetermined size.

The first predetermined shape of the frame member 40 is preferably generally rectangular as illustrated in the drawings. However, it is within the scope of the invention for such shape to be circular (not shown), octagonal (not shown) and hexagonal also (not shown).

The frame member 40 includes a first portion 12 disposed in a substantially horizontal direction and having an opening 14 centrally disposed therein and a second portion 16 attached to an underside 18 of such first portion 12 and disposed in a substantially vertical direction.

There are a predetermined plurality of leg members 22 having a predetermined length and a second predetermined shape connected to such underside 18 of the first portion 12 of such frame member 40 for maintaining such frame member 40 at a desired height above floor level (not shown). In the presently preferred embodiment such article of furniture 10 will include four leg members 22.

A substantially flat member 24 having a smooth finish 26 on one side thereof and a cushion 28 disposed on an opposite side thereof is provided. In the preferred embodiment the cushion 28 is raised above a surface of the substantially flat member 24 and includes a covering 48 selected from the group consisting of cloth, leather and vinyl. Such leg members 22, in the presently preferred embodiment, are formed from wood as is the frame member 40 and the substantially flat member 24.

A first means, generally designated 50, having a first portion 32 thereof disposed on an inner surface 34 of the second portion 16 of the frame member 40 and a second portion 36 disposed diametrically opposite the first portion 32 for enabling rotating of the substantially flat member 24 to expose one of such smooth finish 26 and the cushion 28 as desired.

In the presently preferred embodiment of the invention, each of the first portion 32 and the second portion 36 of the first means 50 include a generally U-shaped member 52. Such U-shaped member 52 is preferably formed from one of wood, metal and plastic.

A third portion 38 of such first means 50 is disposed on a first edge 42 of such substantially flat member 24 and a fourth portion 44 of the first means 50 is disposed diametrically opposite such third portion 38 and on a second edge 46 of such substantially flat member 24.

Each of the third portion 38 and the fourth portion 44 of the first means 50 includes a pin like member 54. Such pin like member 54 can be formed from one of wood, metal and plastic.

A second means, generally designated 60, engageable with such second portion 16 of the frame member 40 on an inner surface 34 thereof and with such substantially flat member 24 for maintaining the substantially flat member 24 in a substantially horizontal plane during use.

Such second means 60 includes a predetermined plurality of apertures 56 formed in the frame like member 40 adjacent the central opening 14 formed therein. Second means 60 further includes a predetermined plurality of pin like members 54 engageable in apertures 56 formed in frame like member 40.

Preferably, such predetermined plurality of apertures 56 formed in the frame like member 40 adjacent central opening 14 and the predetermined plurality of pin like members 54 engageable in the apertures 56 formed in frame like member 40 are identical.

While in accordance with the Patent Statutes both a presently preferred and a number of alternative embodiments have been described in sufficient detail above to enable any person skilled in the relevant art to make and use the same it should be obvious that various other modifications and adaptations of the invention can be made without departing from either the spirit of the invention or the scope of the appended claims.

We claim:

1. An article of furniture which can be converted from a coffee table into an ottoman and vice versa, said article of furniture comprising:

(a) a frame having each of a first predetermined shape and a predetermined size, said frame including a first portion disposed in a substantially horizontal direction and having an opening centrally disposed therein and a second portion attached to an underside of said first portion and disposed in a substantially vertical direction;

(b) a predetermined plurality of leg members having a predetermined length and a second predetermined shape connected to said underside of said first portion of said frame for maintaining said frame at a desired height above floor level;

(c) a substantially flat member, rotatable about a horizontal axis thereof, having a smooth finish on one side thereof and a cushion disposed on an opposite side thereof;

(d) a first means having a generally U-shaped first portion thereof disposed on an inner surface of said second portion of said frame and a generally U-shaped second portion disposed on an inner surface of said frame diametrically opposite said first portion, a third portion of said first means is a pin member disposed on a first edge of said substantially flat member and a fourth portion of said first means is a pin member disposed diametrically opposite said third portion and on a second edge of said substantially flat member for enabling rotating of said substantially flat member to expose one of said smooth finish and said cushion as desired; and (e) a second means engageable with said second portion of said frame on an inner surface thereof and with said substantially flat member for maintaining said substantially flat member in a substantially horizontal plane during use.

2. An article of furniture, according to claim 1, wherein said first predetermined shape of said frame member is selected from generally rectangular, circular, octagonal and hexagonal.

3. An article of furniture, according to claim 2, wherein said predetermined shape is generally rectangular.

4. An article of furniture, according to claim 3, wherein said article of furniture includes four legs.

5. An article of furniture, according to claim 4, wherein said four legs are formed from wood.

6. An article of furniture, according to claim 1, wherein said cushion is raised above a surface of said substantially flat member.

7. An article of furniture, according to claim 6, wherein said cushion includes a covering.

8. An article of furniture, according to claim 1, wherein said covering is selected from the group consisting of cloth, leather and vinyl.

9. An article of furniture, according to claim 1, wherein each generally U-shaped member is formed from one of metal, wood and plastic.

10. An article of furniture, according to claim 1, wherein said pin member is formed from one of metal, wood and plastic.

11. An article of furniture, according to claim 1, wherein said second means includes a predetermined plurality of apertures formed in said frame member adjacent said central opening formed therein.

12. An article of furniture, according to claim 11, wherein said second means further includes a predetermined plurality of pin members engageable in said apertures formed in said frame member.

13. An article of furniture, according to claim 12, wherein said predetermined plurality of apertures formed in said frame member adjacent said central opening formed therein and said predetermined plurality of pin members engageable in said apertures formed in said frame member are identical.

14. An article of furniture, according to claim 1, wherein said frame is formed from wood.

15. An article of furniture, according to claim 1, wherein said predetermined plurality of leg members are formed from wood.

16. An article of furniture, according to claim 1, wherein said substantially flat member is formed from wood.

* * * * *